US011905970B2

(12) United States Patent
Dou et al.

(10) Patent No.: US 11,905,970 B2
(45) Date of Patent: *Feb. 20, 2024

(54) DIFFUSER, CENTRIFUGAL COMPRESSION POWER SYSTEM AND BLADELESS FAN

(71) Applicants: GD MIDEA ENVIRONMENT APPLIANCES MFG CO., LTD., Zhongshan (CN); MIDEA GROUP CO., LTD., Foshan (CN)

(72) Inventors: Hai Dou, Zhongshan (CN); Lie Ma, Zhongshan (CN); Chen Shao, Zhongshan (CN)

(73) Assignees: GD MIDEA ENVIRONMENT APPLIANCES MFG CO., LTD., Zhongshan (CN); MIDEA GROUP CO., LTD., Foshan (CN)

( * ) Notice: Subject to any disclaimer, the term of this patent is extended or adjusted under 35 U.S.C. 154(b) by 679 days.

This patent is subject to a terminal disclaimer.

(21) Appl. No.: 16/819,196

(22) Filed: Mar. 16, 2020

(65) Prior Publication Data

US 2020/0224673 A1 Jul. 16, 2020

Related U.S. Application Data

(63) Continuation of application No. 15/554,009, filed as application No. PCT/CN2015/096053 on Nov. 30, 2015, now Pat. No. 10,634,163.

(30) Foreign Application Priority Data

Mar. 12, 2015 (CN) ..... 201510110206.4
Mar. 12, 2015 (CN) ..... 201520141692.1

(51) Int. Cl.
*F04D 29/44* (2006.01)
*F04D 29/62* (2006.01)
(Continued)

(52) U.S. Cl.
CPC ..... *F04D 29/441* (2013.01); *F04D 17/10* (2013.01); *F04D 25/08* (2013.01); *F04D 29/624* (2013.01)

(58) Field of Classification Search
CPC ..... F04D 17/10; F04D 25/08; F04D 29/441; F04D 29/624
See application file for complete search history.

(56) References Cited

U.S. PATENT DOCUMENTS 3,778,186 A 12/1973 Bandukwalla
3,860,360 A 1/1975 Yu
(Continued)

FOREIGN PATENT DOCUMENTS

CN 201627736 U 11/2010
CN 103277329 A 9/2013
(Continued)

OTHER PUBLICATIONS

First OA for CN application 2015101102064.
Second OA for CN application 2015101102064.
OA for MY application PI2017702696.

*Primary Examiner* — David E Sosnowski
*Assistant Examiner* — Aye S Htay

(57) ABSTRACT

A diffuser includes a lower element and an upper element. The upper element is fixed on the lower element, and the upper element and the lower element are formed separately. The lower element includes a lower inner wall and a lower outer wall, and the upper element includes an upper inner wall and an upper outer wall. The upper inner wall is connected to the lower inner wall to form an internal air-guiding surface, the upper outer wall is connected to the lower outer wall to form an external air-guiding surface, and the internal air-guiding surface is disposed opposite to the external air-guiding surface to define an air-guiding channel for air flow diffusion. The upper element further includes an
(Continued)

upper air-guiding wing for connecting the upper inner wall and the upper outer wall, and the lower element further includes a lower air-guiding wing for connecting the lower inner wall and the lower outer wall.

9 Claims, 3 Drawing Sheets

(51) Int. Cl.
*F04D 17/10* (2006.01)
*F04D 25/08* (2006.01)

(56) References Cited

U.S. PATENT DOCUMENTS 3,905,721 A 9/1975 Fitzpatrick
4,251,183 A * 2/1981 Liu ..... F04D 29/444 415/209.1
6,799,942 B1 * 10/2004 Tzeng ..... F04D 29/542 415/209.1
6,834,501 B1 * 12/2004 Vrbas ..... F04D 17/12 123/562
8,210,795 B2 * 7/2012 Lin ..... F04D 29/542 415/199.5
8,702,386 B2 * 4/2014 Lee ..... F04D 29/384 415/220
2011/0236229 A1 * 9/2011 Fitton ..... F04D 25/08 55/471
2012/0014788 A1 * 1/2012 Blair ..... F04D 29/444 415/208.2
2014/0210114 A1 * 7/2014 Staniforth ..... F24F 6/14 261/30

FOREIGN PATENT DOCUMENTS

CN 204532971 U 8/2015
EP 0305879 A2 3/1989
EP 1860325 A1 11/2007
JP 2004027932 A 1/2004
JP 2011074911 A 4/2011
JP 2012197797 A 10/2012

* cited by examiner

DIFFUSER, CENTRIFUGAL COMPRESSION POWER SYSTEM AND BLADELESS FAN

CROSS-REFERENCES TO RELATED APPLICATIONS

This application is a Continuation Application based on U.S. application Ser. No. 15/554,009, filed Aug. 28, 2017, which claims the benefit of prior Chinese Applications No. 201510110206.4 and No. 201520141692.1, both filed with the State Intellectual Property Office of P. R. China on Mar. 12, 2015, the entire contents of which are incorporated herein by reference.

FIELD

The present disclosure relates to centrifugal compression technologies, more particularly relates to a diffuser, a centrifugal compression power system and a bladeless fan.

BACKGROUND

A bladeless fan in the related art generally includes a diffuser. An air-guiding wing of the diffuser is disposed between an outer wall and an inner wall. However, the air-guiding wing is easy to fracture due to a shrinkage strain thereof. Accordingly, the air-guiding wing of the diffuser in the related art is mostly formed separately and then fixed between the inner wall and the outer wall; alternatively, the air-guiding wing and the inner wall are formed integrally, and the air-guiding wing is fixed by being embedded in a groove of the outer wall. However, such a structure is complex and inconvenient to mount and detach, thereby increasing labor intensity and production costs.

SUMMARY

Embodiments of the present disclosure seek to solve at least one of the problems existing in the related art. Thus, the present disclosure is to provide a diffuser.

The present disclosure further provides a centrifugal compression power system.

The present disclosure further provides a bladeless fan.

The diffuser according to preferred embodiments of the present disclosure includes a lower element and an upper element, the upper element is fixed on the lower element, and the upper element and the lower element are formed separately. The lower element includes a lower inner wall and a lower outer wall, and the upper element includes an upper inner wall and an upper outer wall. The upper inner wall is connected to the lower inner wall to form an internal air-guiding surface, and the upper outer wall is connected to the lower outer wall to form an external air-guiding surface. The internal air-guiding surface is disposed opposite to the external air-guiding surface, and an air-guiding channel for air flow diffusion is defined between the internal air-guiding surface and the external air-guiding surface. The upper element further includes an upper air-guiding wing for connecting the upper inner wall and the upper outer wall, and the lower element further includes a lower air-guiding wing for connecting the lower inner wall and the lower outer wall. The upper air-guiding wing is connected to the lower air-guiding wing to form an air-guiding wing for connecting the internal air-guiding surface and the external air-guiding surface.

The diffuser according to preferred embodiments of the present disclosure is divided into the upper element and the lower element, the upper element and the lower element are formed separately, and the air-guiding wing is formed by connecting the upper air-guiding wing and the lower air-guiding wing. Since the air-guiding wing is divided into two parts, fractures of the air-guiding wing due to a shrinkage strain thereof are reduced. Furthermore, the diffuser has a simple structure and is convenient to mount and detach, which reduces labor intensity and production costs.

In some embodiments, a plurality of air-guiding wings is provided equiangularly.

In some embodiments, a through hole is formed in the internal air-guiding surface, and the through hole is located between two adjacent lower air-guiding wings.

In some embodiments, the upper element is connected to the lower element through a screw.

The centrifugal compression power system according to preferred embodiments of the present disclosure includes a diffuser according to any one of embodiments described above.

In some embodiments, the power system further includes a motor and an impeller connected to the motor, in which the motor is located between the diffuser and the impeller, and the diffuser is connected downstream of an airflow produced by the impeller.

The bladeless fan according to preferred embodiments of the present disclosure includes a power system including a diffuser according to any one of embodiments described above.

Additional aspects and advantages of embodiments of the present disclosure will be given in part in the following descriptions, become apparent in part from the following descriptions, or be learned from the practice of the embodiments of the present invention.

BRIEF DESCRIPTION OF THE DRAWINGS

In order to more clearly illustrate the technical solution of embodiments of the present disclosure, the drawings, which are intended to be used in the description of the embodiments, will be briefly described below. It will be apparent that the drawings described in the following description are merely exemplary embodiments of the present invention. Those skilled in the art will be able to obtain additional drawings in accordance with these drawings without creative effort.

DETAILED DESCRIPTION OF THE INVENTION

Figure 1:
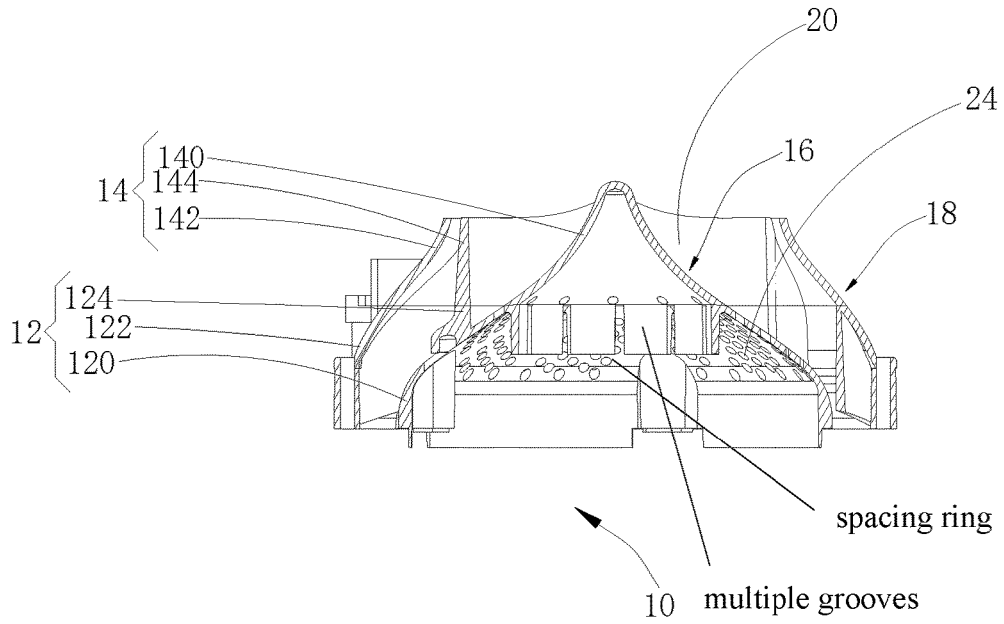
FIG. 1 illustrates a sectional view of a diffuser according to a preferred embodiment of the present disclosure.

The technology solution in the embodiments of the present disclosure will be clearly and completely described below with reference to the drawings in the embodiments of the present disclosure, and it will be apparent that the described embodiments are merely part of the embodiments of the present disclosure and are not intended to be exhaustive. Based on embodiments of the present disclosure, all other embodiments obtained by those skilled in the art without creative effort are within the scope of the present disclosure.

In the specification, it is to be understood that terms such as "central," "longitudinal," "lateral," "upper," "lower," "front," "rear," "left," "right," "vertical," "horizontal," "top," "bottom," "inner," "outer," should be construed to refer to the orientation as then described or as shown in the drawings under discussion. These relative terms are for convenience of description and do not require that the present disclosure be constructed or operated in a particular orientation. In addition, terms such as "first" and "second" are used herein for purposes of description and are not intended to indicate or imply relative importance or significance.

In the present disclosure, unless specified or limited otherwise, the terms "mounted," "connected," "coupled" and the like are used broadly, and may be, for example, fixed connections, detachable connections, or integral connections; may also be mechanical or electrical connections; may also be direct connections or indirect connections via intervening structures; may also be inner communications of two elements. The above terms can be understood by those skilled in the art according to specific situations.

Embodiments of the present disclosure will be further described in detail below with reference to drawings.

Referring to FIG. 1, a diffuser 10 according to preferable embodiments of a first aspect of the present disclosure includes a lower element 12 and an upper element 14, the upper element 14 is fixed on the lower element 12, and the upper element 14 and the lower element 12 are separately formed.

The lower element 12 includes a lower inner wall 120 and a lower outer wall 122, and the upper element 14 includes an upper inner wall 140 and an upper outer wall 142. The upper inner wall 140 is connected to the lower inner wall 120 to form an internal air-guiding surface 16, and the upper outer wall 142 is connected to the lower outer wall 122 to form an external air-guiding surface 18. The internal air-guiding surface 16 is disposed opposite to the external air-guiding surface 18, and an air-guiding channel 20 configured to diffuse an airflow is defined between the internal air-guiding surface 16 and the external air-guiding surface 18.

The upper element 14 further includes an upper air-guiding wing 144 for connecting the upper inner wall 140 and the upper outer wall 142, and the lower element 12 further includes a lower air-guiding wing 124 for connecting the lower inner wall 120 and the lower outer wall 122. The upper air-guiding wing 144 is connected to the lower air-guiding wing 124 to form an air-guiding wing 22 configured to connect the internal air-guiding surface 16 and the external air-guiding surface 18.

The diffuser 10 according to preferable embodiments of the first aspect of the present disclosure is divided into the upper element 14 and the lower element 12, the upper element 14 and the lower element 12 are separately formed, and the air-guiding wing 22 is formed by connecting the upper air-guiding wing 144 and the lower air-guiding wing 124. Since the air-guiding wing 22 is divided into two parts, fractures of the air-guiding wing 22 due to a shrinkage strain thereof can be reduced. Furthermore, the diffuser 10 has a simple structure and is convenient to mount and detach, which reduces labor intensity and production costs.

Specifically, the upper element 14 is connected to the lower element 12 to form the diffuser 10, and the upper element 14 and the lower element 12 are each configured as a structure having a larger end and a smaller end, which facilitates diffusion of the airflow.

The upper air-guiding wing 144 in a spiral shape is provided between the upper inner wall 140 and the upper outer wall 142 of the upper element 14, the lower air-guiding wing 124 in a spiral shape is provided between the lower inner wall 120 and the lower outer wall 122 of the lower element 12, and the upper air-guiding wing 144 and the lower air-guiding wing 124 are butted together to form the air-guiding wing 22.

The upper outer wall 142 is configured as a structure which contracts towards a center of the diffuser, the upper inner wall 140 is located at a center of the upper outer wall 142, and the upper air-guiding wing 144 extends from a center of the upper inner wall 140 to the upper outer wall 142 and exhibits a spiral shape.

The lower outer wall 122 is configured as a structure which contracts towards the center of the diffuser, the lower outer wall 122 encloses the lower inner wall 120, a top end of the lower inner wall 120 forms a circular opening, and the lower air-guiding wing 124 extends from the lower inner wall 120 to the lower outer wall 122.

The upper outer wall 142 includes a first end 14*a* and a second end 14*b* opposite to each other in an up-and-down direction, and the lower outer wall 122 includes a third end 12*a* and a fourth end 12*b* opposite to each other in the up-and-down direction. The second end 14*b* of the upper outer wall 142 and the third end 12*a* of the lower outer wall 122 are butted together, and a bottom end of the upper inner wall 140 and the circular opening of the lower inner wall 120 are butted together. A diameter of the fourth end 12*b* of the lower outer wall 122 is greater than that of the first end 14*a* of the upper outer wall 142. A junction of the upper element 14 and the lower element 12 is configured as a smooth transition.

In the present embodiment, the upper air-guiding wing 144 and the lower air-guiding wing 124 are butted together in the up-and-down direction to form the air-guiding wing 22. Preferably, the number of the upper air-guiding wings 144 is 11, the number of the lower air-guiding wings 124 is 11, and the number of the air-guiding wings 22 is 11. The air-guiding wing 22 is shaped like a curved sheet and is streamlined, the air-guiding wing 22 extends outwardly from the center of the diffuser 10 in a radial direction, a plurality of the air-guiding wings 22 is spiral in shape and disposed equiangularly, and the airflow entering the diffuser 10 is expelled in a spiral airflow shape through the air-guiding wing 22.

Thus, the spiral air-guiding wing 22 can weaken swirling strength of the airflow in the diffuser 20.

In the present embodiment, the upper inner wall 140 is connected to the lower inner wall 120 to form the internal air-guiding surface 16. A plurality of circular through holes 24 is formed in the internal air-guiding surface 16 and is distributed evenly between two adjacent lower air-guiding wings 124.

In the present embodiment, the upper element 14 is detachably mounted on the lower element 12. Specifically, four screw holes are formed in an outer surface of the upper outer wall 142 of the upper element 14, and four screw holes are formed in an outer surface of the lower outer wall 122 of the lower element 12. During the assembling of the diffuser 10, the second end 14*b* of the upper outer wall 142 and the third end 12*a* of the lower outer wall 122 are butted together, and the screw holes of the upper outer wall 142 are aligned with the screw holes of the lower outer wall 122 respectively to connect the upper element 14 with the lower element 12 through screws. Thus, the upper element 14 and the lower element 12 can be mounted and detached conveniently. A reinforcing rib is formed at the screw holes of the upper outer wall 142 and the lower outer wall 122 to improve strength.

Figure 2:
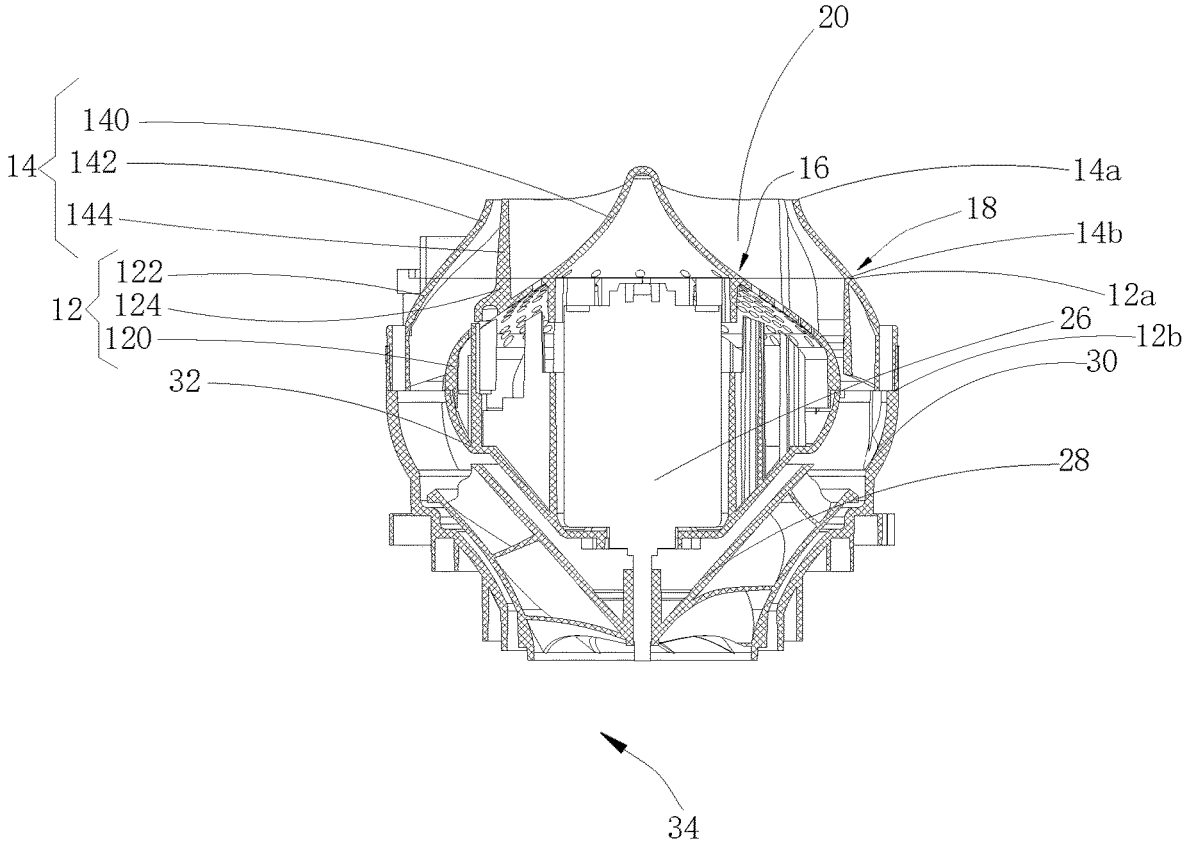
FIG. 2 illustrates a sectional view of a centrifugal compression power system according to a preferred embodiment of the present disclosure.
Figure 3:
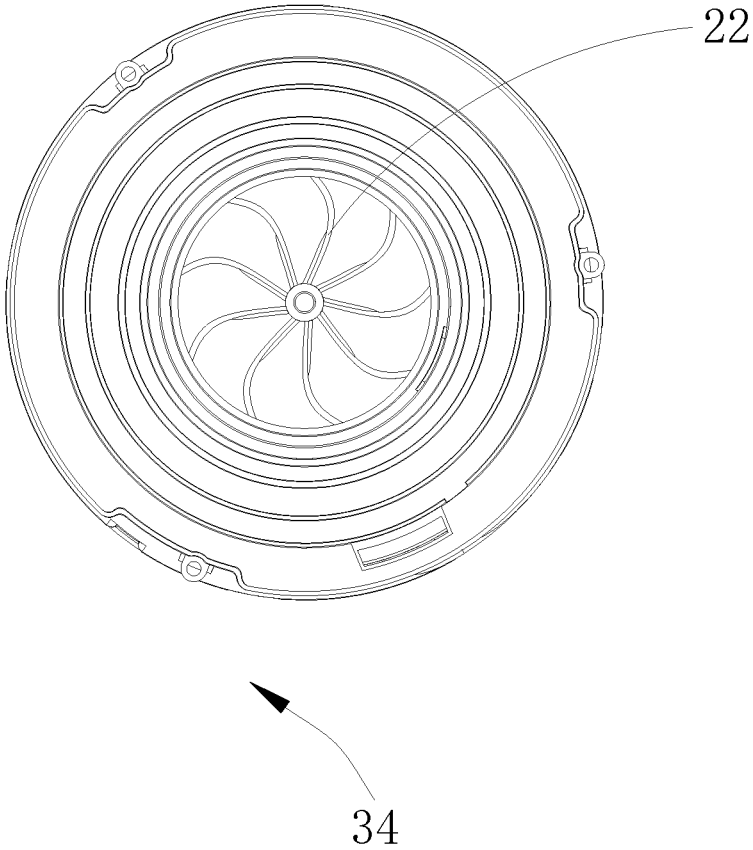
FIG. 3 illustrates a top view of a centrifugal compression power system according to a preferred embodiment of the present disclosure.
Figure 4:
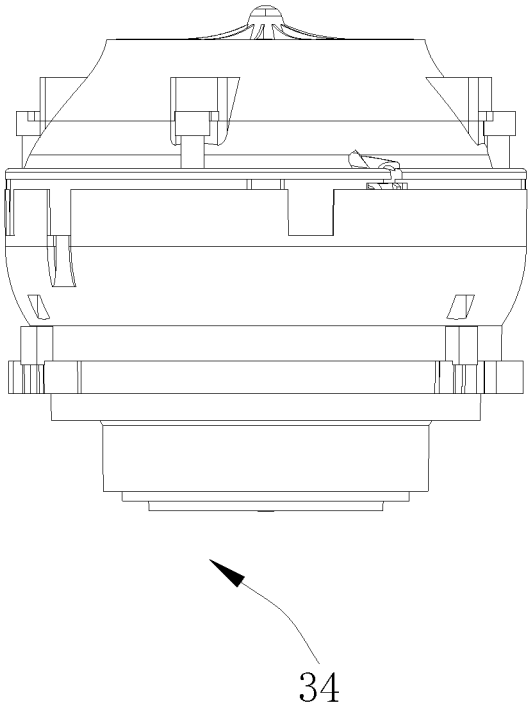
FIG. 4 illustrates a perspective view of a centrifugal compression power system according to a preferred embodiment of the present disclosure.

Referring to FIGS. 2 and 4, preferred embodiments of a second aspect of the present disclosure provide a centrifugal compression power system 34. The power system 34 includes a motor 26, an impeller 28 connected to the motor 26, and the diffuser 10 located downstream of the airflow produced by the impeller 28. The motor 26 is located between the diffuser 10 and the impeller 28. The impeller 28 is driven by the motor 26 to rotate at a high speed, and the diffuser 10 decelerates and pressurizes the airflow produced by the high-speed rotation of the impeller 28 and eliminates swirls of the airflow.

An impeller housing 30 is disposed outside the impeller 28. The lower element 12 of the diffuser 10 is connected to the impeller housing 30. The motor 26 is located in the impeller housing 30 with a substantially frustoconical shape and is mounted to the impeller housing 30, and a rotary shaft of the motor 26 is fixedly connected to the impeller 28 to drive the impeller 28 to rotate at a high speed. A motor housing 32 is disposed outside the motor 26, and the lower inner wall 120 of the diffuser 10 extends downwardly and is jointed with the motor housing 32 to support the motor housing 32.

A bladeless fan according to preferred embodiments of a third aspect of the present disclosure includes a machine head, a base, an air-guiding duct for communicating the machine head and the base, and the power system 34. The power system 34 is disposed in the base.

The diffuser 10 is located in a diffusion section of an air flow path of the bladeless fan. An high-speed airflow formed by the impeller 28 enters the air-guiding channel 20 of the diffuser 10, the air-guiding wing 22 guides the airflow to enter the air-guiding duct and leads the airflow to the machine head, and the airflow can be jetted from a nozzle of the machine head. The diffuser 10 is configured to guide the airflow formed by the rotation of the impeller 28 towards an air outtake port of the base in communication with the air-guiding duct, and the diffuser 10 can decelerate and pressurize the high-speed airflow produced by the impeller 28 and eliminate swirls of the airflow.

Reference throughout this specification to "an embodiment," "some embodiments," "an example," "a specific example," or "some examples," means that a particular feature, structure, material, or characteristic described in connection with the embodiment or example is included in at least one embodiment or example of the present disclosure. Thus, the appearances of the phrases in various places throughout this specification are not necessarily referring to the same embodiment or example of the present disclosure. Furthermore, the particular features, structures, materials, or characteristics may be combined in any suitable manner in one or more embodiments or examples.

Although explanatory embodiments have been shown and described, it would be appreciated by those skilled in the art that the above embodiments cannot be construed to limit the present disclosure, and changes, alternatives, and modifications can be made in the embodiments without departing from principles and scope of the present disclosure. The scope of the present disclosure is defined by the attached claims and equivalents thereof.

What is claimed is:

1. A diffuser configured to be used in a bladeless fan, comprising:

a lower element; and an upper element fixed on the lower element;

wherein the upper element is above the lower element in a vertical direction of the diffuser, and airflow is guided by the lower element towards the upper element wherein the upper element and the lower element are formed separately; the lower element comprises a lower inner wall and a lower outer wall, and the upper element comprises an upper inner wall and an upper outer wall; the upper inner wall is connected to the lower inner wall to form an internal air-guiding surface; the upper outer wall is connected to the lower outer wall to form an external air-guiding surface; the internal air-guiding surface is disposed opposite to the external air-guiding surface, and an air-guiding channel configured to diffuse an airflow is defined between the internal air-guiding surface and the external air-guiding surface; the upper element further comprises an upper air-guiding wing for integrally connecting the upper inner wall and the upper outer wall, and the lower element further comprising a lower air-guiding wing for integrally connecting the lower inner wall and the lower outer wall; the upper air-guiding wing is connected to the lower air-guiding wing to form an air-guiding wing for connecting the internal air-guiding surface and the external air-guiding surface;

wherein the lower end of the upper outer wall abuts the upper end of the lower outer wall;

wherein the lower outer wall and the upper outer wall forms a outer wall, the lower inner wall and the upper inner wall forms an inner wall, both diameters of the outer wall and the inner wall decrease gradually from lower end of the diffuser to upper end of the diffuser; and p1 the inner wall is in shape of a cone, upper end of the inner wall forms vertex of the cone.

2. The diffuser according to claim 1, wherein the air-guiding wing comprises a plurality of air-guiding wings, and the plurality of air-guiding wings are spiral in shape and provided equiangularly;

wherein each of the plurality of air-guiding wings is shaped like a curved sheet and streamlined, each of the plurality of air-guiding wings extends outwardly from a center of the diffuser in a radial direction, and the airflow entering the diffuser is expelled in a spiral airflow shape through the plurality of air-guiding wings.

3. The diffuser according to claim 1, wherein a through hole is formed in the internal air-guiding surface, and the through hole is located between two adjacent lower air-guiding wings.

4. The diffuser according to claim 1, wherein the upper element is connected to the lower element through a screw.

5. The diffuser according to claim 1, further comprising a spacing ring extending downwardly from inner surface of the lower inner wall, the spacing ring is provided with multiple through grooves.

6. A centrifugal compression power system, comprising: a diffuser according to claim 1.

7. The centrifugal compression power system according to claim 6, further comprising:

a motor, and an impeller connected to the motor, wherein the motor is located between the diffuser and the impeller, and the diffuser is connected downstream of an airflow produced by the impeller.

8. A bladeless fan, comprising:

a centrifugal compression power system, wherein the centrifugal compression power system comprises a diffuser according to claim 1.

9. The diffuser according to claim 1, wherein the upper air-guiding wing connects with inner surface of the upper outer wall, the lower air-guiding wing connects with outer surface of the lower inner wall, and connection section of the upper air-guiding wing and the lower air-guiding wing is located within the air-guiding channel.

* * * * *